United States Patent [19]

Pritchard

[11] Patent Number: 4,844,518

[45] Date of Patent: Jul. 4, 1989

[54] ROTO CAM LATCH

[75] Inventor: Timothy R. Pritchard, Grants Pass, Oreg.

[73] Assignee: Environmental Container Systems, Inc., Grants Pass, Oreg.

[21] Appl. No.: 90,025

[22] Filed: Aug. 27, 1987

[51] Int. Cl.[4] ..... E05C 9/00

[52] U.S. Cl. ..... 292/28; 292/43; 292/55; 292/115; 292/212

[58] Field of Search ..... 220/324, 325, 327, 328; 292/109, 111, 112, 115, 155, 212, 43, 55, 56, 71, 28

[56] References Cited

U.S. PATENT DOCUMENTS

| | | | |
|---|---|---|---|
| 80,295 | 7/1868 | Lotridge | 292/212 |
| 135,822 | 2/1873 | La Forge | 292/55 |
| 284,899 | 9/1883 | Reynolds | 292/115 |
| 330,986 | 11/1885 | Kuehn | 292/212 |
| 424,454 | 4/1890 | Biery | 292/212 |
| 699,580 | 5/1902 | Scrivens | 292/212 |
| 1,137,302 | 4/1915 | Beach | 292/229 |
| 1,416,308 | 5/1922 | Silverman | 292/43 |
| 1,815,540 | 7/1931 | Black et al. | 292/212 |
| 2,269,264 | 1/1942 | Haim | 292/62 |
| 2,476,471 | 7/1949 | Wilson | 292/55 |
| 2,833,005 | 5/1958 | Barry | 292/115 |
| 2,961,265 | 11/1960 | Jakeman et al. | 292/216 |
| 2,991,106 | 7/1961 | Claud-Mantle | 292/111 |
| 3,510,162 | 5/1970 | Smith et al. | 292/241 |
| 3,885,701 | 5/1973 | Becklin | 220/325 |
| 4,199,176 | 4/1980 | Kelly | 292/38 |
| 4,461,597 | 7/1984 | Laurin | 220/235 |

FOREIGN PATENT DOCUMENTS

| | | | |
|---|---|---|---|
| 26810 | 10/1926 | Denmark | 292/212 |
| 55212 | 8/1938 | Denmark | 292/55 |
| 695918 | 10/1930 | France | 292/212 |
| 4046 | of 1887 | United Kingdom | 292/115 |
| 5900 | of 1889 | United Kingdom | 292/212 |
| 191428 | 1/1923 | United Kingdom | 292/55 |

*Primary Examiner*—Gary L. Smith
*Assistant Examiner*—Eric K. Nicholson
*Attorney, Agent, or Firm*—Limbach, Limbach & Sutton

[57] ABSTRACT

A sealable, reusable shipping container having a highly reliable interior latching mechanism which is actuated on the exterior of the container without using special tools is provided. The unique latching mechanism can be adapted to securely closing and sealing any type of container. The latching mechanism converts the rotary force applied to be actuating device, such as a knob, into both vertical motion, for enabling a latch member to engage and disengage a catch, and horizontal motion to tighten the latch and catch against each other when the latching mechanism is engaged and to separate the latch and catch when the latching mechanism is disengaged to allow opening of the container.

18 Claims, 2 Drawing Sheets

ROTO CAM LATCH

TECHNICAL FIELD

The present invention relates to latching mechanisms. In particular, the present invention relates to latches for reusable shipping containers.

BACKGROUND ART

Modern shipping containers are subjected to rough handling and must be waterproof or water resistant and built to withstand dropping, impact with other containers, and other adverse shipping conditions without transmitting the shock to the equipment or product packed inside. This is particularly true for containers used to ship delicate or shock-sensitive transportable electronic equipment.

Such containers are ideally opened and closed quickly and easily using fasteners which provide both a strong and effective closure of the container and which are not subject to accidental opening. Such fasteners should be able to seal the cover of the container down against the body of the container, or down against a seal between the cover and the body to prevent the penetration of liquids into the interior. Further, such a fastener should be contained as much as possible inside the container in order to protect the latching mechanism from adverse shipping conditions. Finally, such a fastener should be reliable and not subject to accidental opening while the container is in transit.

While many existing shipping containers have latching mechanisms which meet some of these criteria, they do not meet all of the criteria. For example, U.S. Pat. No. 330,986 discloses a box fastener which uses a screw bolt to hold a fastening strip in place, holding the cover of a box down after the fastening strip has engaged an inner lip on the cover of the box and the cover has been closed. Although this "latching mechanism" is largely contained within the box, it does not pull the cover down against the box to seal the container from the entry of, for example, liquids. Further, opening and closing the cover on this type of box is tedious and would likely require a special tool such as a wrench for rotating the bolt into or out of a threaded plate.

Similarly, U.S. Pat. No. 2,269,264 discloses a latching mechanism in which a captive screw is rotated to rotate a latch into position and then to pull the latch on the inside against a wall, closing the cover against the wall. In such a structure, a special tool such as a screw driver is required to close and lock the cover. Further, repeated uses subject the threads of the captive screw to stripping.

U.S. Pat. Nos. 2,961,265 and 3,510,162 provide latching mechanisms which are disengaged to open by pulling out on a handle. Such mechanisms are totally unsuitable for shipping containers, since the external handles could be snagged, causing accidental opening of the container in transit.

Thus, the need exists for a latching mechanism for modern reusable shipping containers which is easy to use, reliable, not subject to accidental opening, which can be contained on the inside of the container, but which can be operated from outside the container without the use of special tools, and which can provide sufficient sealing force to exclude unwanted liquids, dust or other contaminants from the interior of a shipping container.

SUMMARY OF THE INVENTION

The present invention provides a highly reliable latching mechanism for reusable containers.

In one embodiment, the present invention provides a locking latch for a reusable container. The latch of this embodiment includes a stationary catch member mounted on one part of the container, for example, the interior of the body of the container, and a movable latching mechanism mounted on another part of the container, for example, the interior cover of the container. A knob or other actuating device operates the movable latching mechanism from outside the container. For example, when a knob is used as the actuating device, the container cover and body are joined, and the movable latching mechanism is engaged and tightened against the stationary catch by turning the knob a short distance in one direction. To unlock the mechanism and open the container, the knob is turned a similar short distance in the opposite direction and the cover is removed.

In another embodiment, the present invention provides a reusable container having a plurality of locking latches as necessary to close and seal the container. In this embodiment, each locking latch may be individually actuated by a means, such as a knob. Thus, to open or close such a container would involve serially turning each knob for each locking latch.

Alternatively, a plurality of the locking latches may be actuated simultaneously by using a cable and pulley arrangement in conjunction with a single actuating means, such as a knob. Thus, to open or close a plurality of locking latches for such a container would only involve turning a single knob a short distance.

BRIEF DESCRIPTION OF THE DRAWINGS

A better understanding of the invention and its advantages will be apparent from the detailed description taken in conjunction with the accompanying drawings in which.

DETAILED DESCRIPTION OF THE INVENTION

Figure 1:
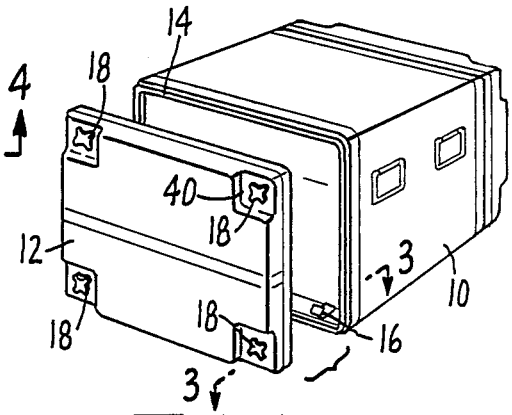
FIG. 1 is a perspective view of a container of the present invention having eight locking latches of the present invention, four each front and rear.

FIG. 1 shows a container of the present invention comprising at least two parts: a container body 10 and a container cover 12. Body 10 and cover 12 are adapted to cooperate with each other at interface 14, which may include a seal. Inside body 10 is mounted a stationary catch 16 adapted to cooperate with a movable locking latch of the present invention mounted within cover 12 and actuated by knob 18. While this is the preferred placement of catch 16 and the movable locking latch, it is also possible to mount the catch in cover 12 and to mount the movable locking latch in body 10. The container shown in FIG. 1 is closed and locked by placing cover 12 so that it engages body 10 at interface 14, and turning each of the knobs 18 to enable the locking latches in cover 12 to engage and tighten against the opposing catch 16 in body 10.

FIGS. 2–5 more clearly show the construction and operation of a locking latch of the present invention. Knob 18 is attached to one end of a threaded shaft 22. The other end of threaded shaft 22 is attached to mounting bracket 24. Mounted on the threaded portion of threaded shaft 22 is threaded receiver 26 and slidable bracket 28. Thus, when knob 18 is rotated, for example by turning it clockwise, slidable bracket 28 will move from a first position in a direction parallel to the axis of threaded shaft 22 until the end of the threads or a stop is reached. When knob 18 is rotated in an opposite direction, for example counterclockwise, slidable bracket 28 will reverse its direction of travel and move in a direction parallel to the axis of threaded shaft 22 back towards its first position.

At the end of slidable bracket 28 is attached a movable latch member 30 adapted to cooperate with catch 16. Movable latch member 30 and catch 16 are preferably constructed from steel or other strong structural materials suitable for forming such latches. Movable latch member 30 can be moved or pivoted up out of the plane formed by the top surface of slidable bracket 28 or down into the plane formed by the top surface of slidable bracket 28. Preferably movable latch member 30 is attached to slidable bracket 28 as shown, by passing a small rod or dowel 32 through both the end of slidable bracket 28 and an end of movable latch member 30 formed to receive rod 32. This particular method of attachment is preferred because it permits further adaptation of movable latch member 30 to receive a spring 34 for forcing latch member 30 up out of the plane formed by the top surface of slidable bracket 28.

Figure 2:
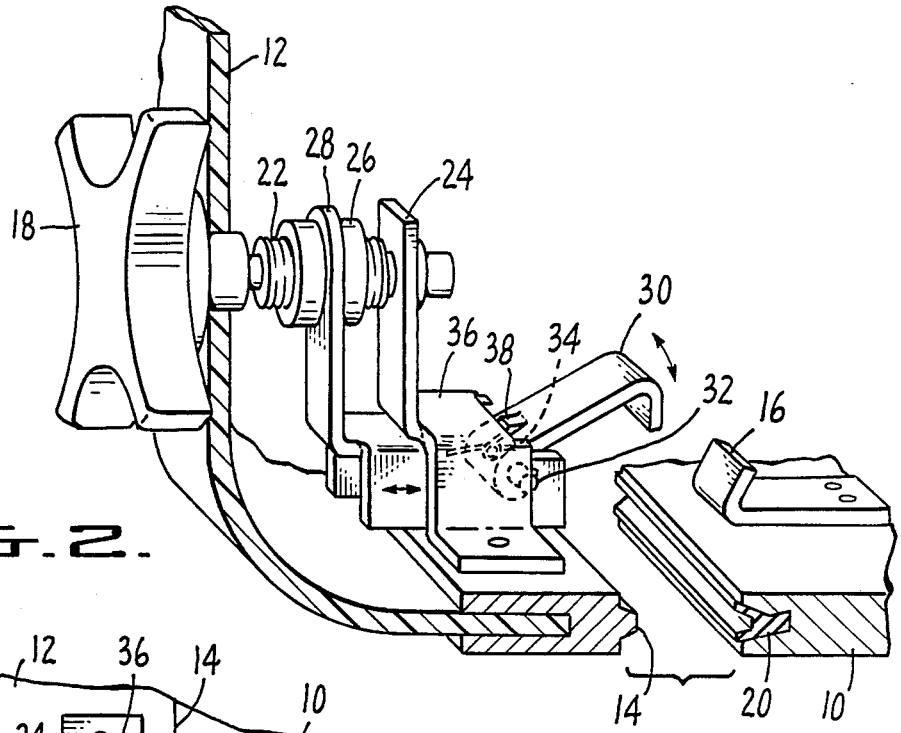
FIG. 2 is a cross-sectional side view of a container of the present invention in an open configuration showing a locking latch of the present invention in perspective, operably mounted on the interior of the container.
Figure 3:
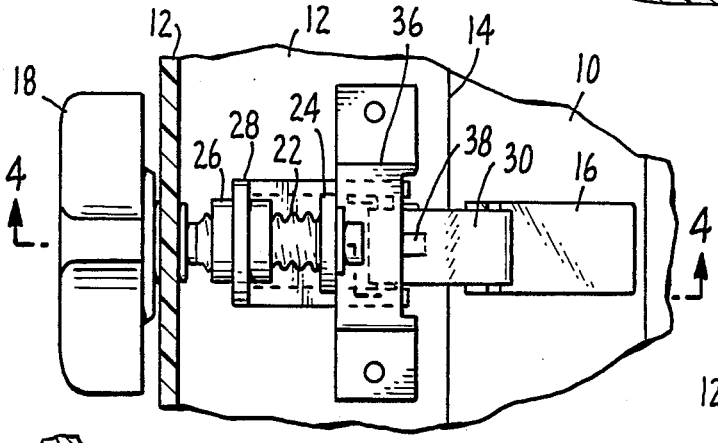
FIG. 3 is a sectional top view taken along line 3—3 of FIG. 1.
Figure 4:
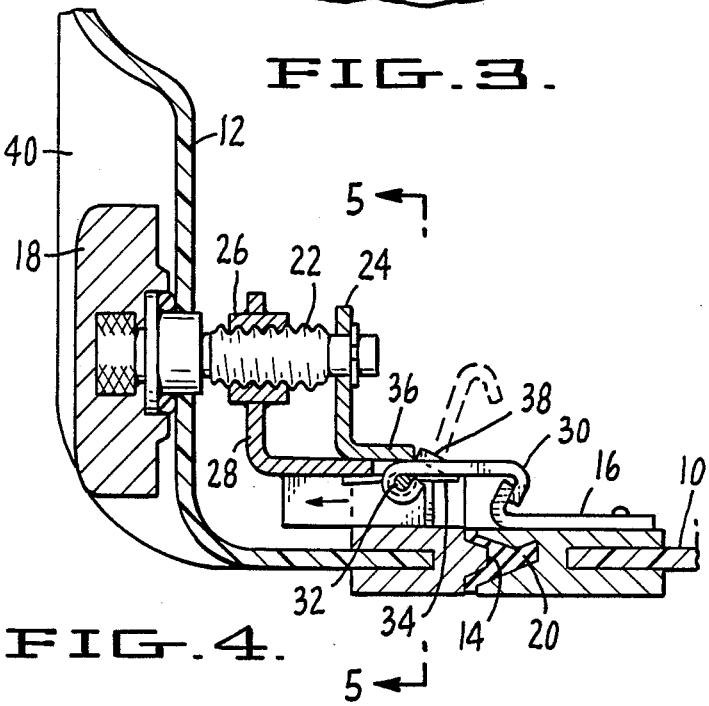
FIG. 4 is a sectional side view taken along line 4—4 of FIG. 3.
Figure 5:
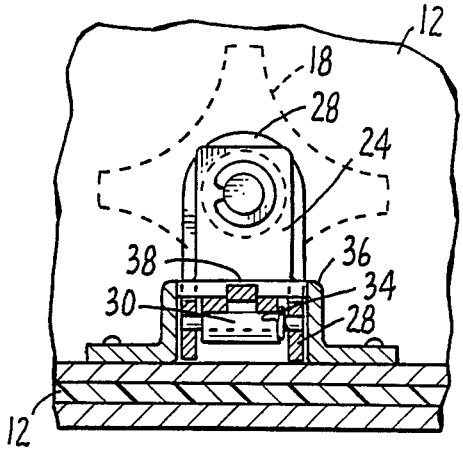
FIG. 5 is a sectional end view taken along line 5—5 of FIG. 4.

Movement of latch member 30 is effectuated by placing a barrier 36 between the first end of slidable bracket 28 at threaded receiver 26 and the second end of slidable bracket 28 at movable latch member 30. Preferably this barrier 36 is provided in combination with mounting bracket 24 as a single piece or component; however, one skilled in the art will recognize that it would be possible to mount the end of threaded shaft 22 and provide a barrier 36 independently. Such a barrier 36 will act upon the back surface of the movable latch member where it attaches to slidable bracket 28 as slidable bracket 28 moves through barrier 36. Thus, when threaded receiver 26 is moved toward mounting bracket 24 by the rotation of threaded shaft 22, the back surface of movable latch member 30 is pushed out from under barrier 36, eliminating the impediment to upward movement out of the plane of the top surface of slidable bracket 28, and spring 34 forces movable latch member 30 up. An alternative or additional feature to aid the upward and downward motion of movable latch member 30 is a raised wedge 38 formed on the back surface of movable latch member 30, as shown in FIGS. 2 and 4.

The operation of this locking latch (hereinafter referred to as a "roto cam latch") in conjunction with a container is illustrative of the many advantages it has over prior art fasteners. When container cover 12 and container body 10 are engaged at interface 14, the cover is locked on by actuating the roto cam latches. In the preferred mode, this is done by turning each knob 18 mounted on the outside of the container in a first direction. This motion rotates threaded shaft 22, moving threaded receiver 26 toward knob 18, pulling the back surface and raised wedge 38 of latch member 30 against and under barrier 36, forcing movable latch member 30 down and into engagement with catch 16. As the movement of threaded receiver 26 towards knob 18 continues movable latch member 30 is tightened against catch 16, forcing container interface 14 tightly against seal 20. By the time threaded receiver 26 has moved as far as it can go toward knob 18, the container cover 12 is tightly sealed against the container body 10. The roto cam latch can be completely engaged and tightened, or disengaged by rotating knob 18.

To open the container, one simply reverses the direction of knob rotation from the first direction. As threaded shaft 22 rotates, threaded receiver 26 moves toward mounting bracket 24 initially pushing latch member 30 towards catch 16, loosening the connection between them. As the movement of threaded receiver 26 continues, the back surface of movable latch member 30 is pushed out from under barrier 36. Where latch member 30 has a raised wedge 38, barrier 36 acts upon raised wedge 38 to lift latch member 30 up and out of engagement with catch 16 as it is pushed out from under barrier 36. Where latch member 30 has a spring 34 compressed against its inner surface, as soon as the back surface of latch member 30 is pushed out from under barrier 36, eliminating the impediment to upward movement out of the plane of the top surface of slidable bracket 28, the spring 34 will force movable latch member 30 up and out of engagement with catch 16. Again, complete movement of threaded receiver 26 from the fully locked position to the fully unlocked position is accomplished by rotating knob 18.

Because each roto cam latch is individually actuated, a maximum degree is reliability and assurance against accidental opening of the container in transit is assured. Further reliability can be obtained by protecting the actuating device. For example, if a knob is used, the container may be constructed to have a recess 40 on the exterior surface within which the knob is contained. While a knob 18 is the preferred actuating device, since it permits actuation of the roto cam latch without the use of special tools, it is obvious that other means for turning threaded shaft 22 will also work.

Figure 6:
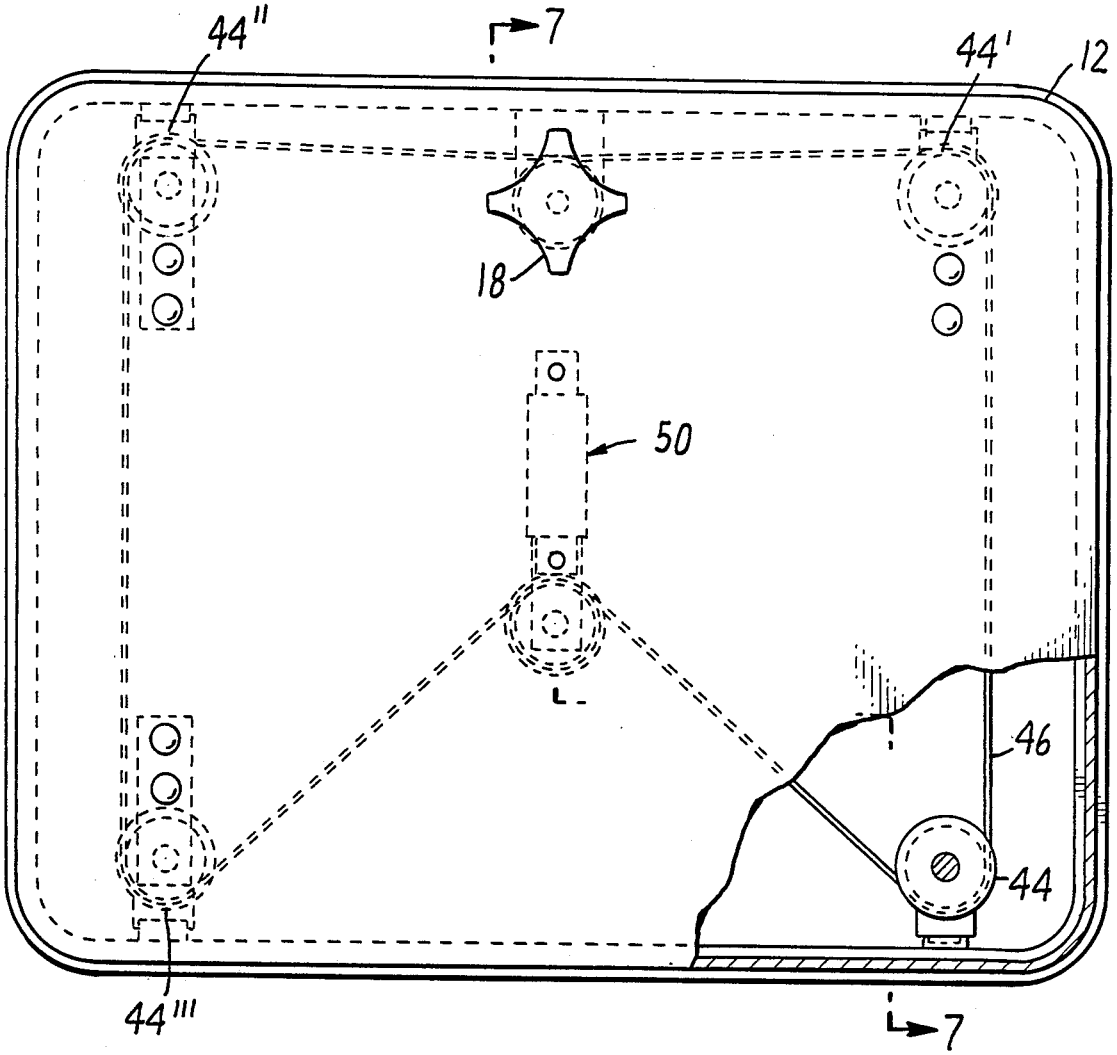
FIG. 6 is a top view partially cut away of a container of the present invention showing locking latches of the present invention actuated by the rotation of their pulleys by the movement of a cable actuated by the rotation of a single exterior knob; and, FIG. 7 is a sectional side view through line 7—7 of FIG. 6, showing a pulley actuated roto cam latch in conjunction with a tensioning device and a single actuating knob.
Figure 7:
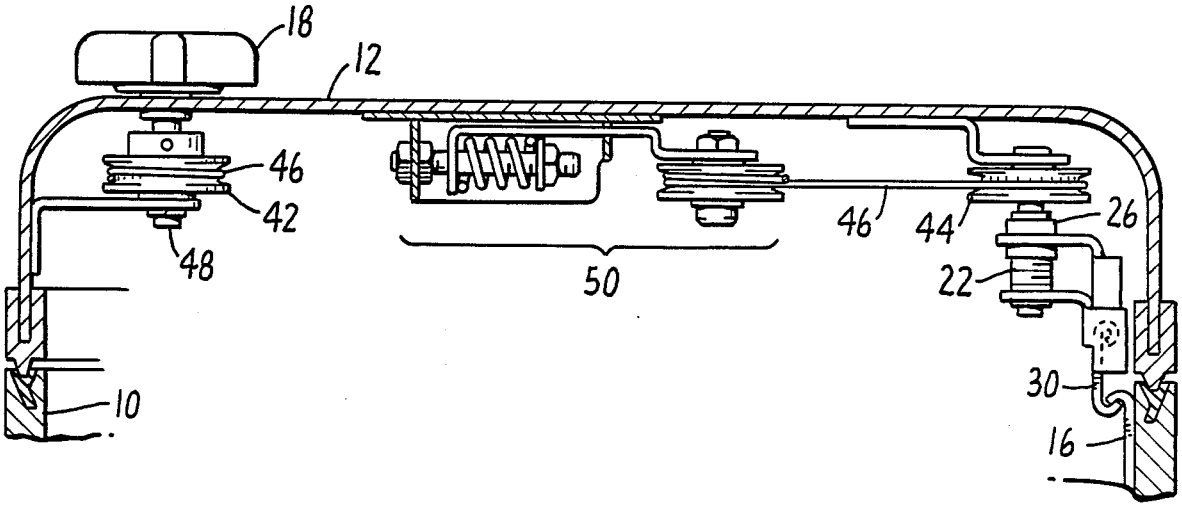

FIGS. 6 and 7 illustrate a means for actuating more than one roto cam latch on a container using a single actuating device, such as a single knob. In this embodiment, a container of the present invention is constructed with a plurality of roto cam latches mounted on the interior of cover 12. On an end of each threaded shaft is mounted an actuating pulley 44. Also mounted on cover 12 is knob 18 as an actuating device. Knob 18 may be independent of any of the roto cam latches, and thus mountable anywhere on cover 12. In this configuration, knob 18 is supported on a first end of knob shaft 48, which passes through cover 12 into the interior of cover 12. On the second end of knob shaft 48 is mounted a fixed, knob pulley 42 which is not freely rotatable and rotates only when knob 18 rotates knob shaft 48. A cable 46 is placed in an engaging relationship connecting the knob pulley 42 and the actuating pulleys 44 fixed to threaded shafts 22 such that when knob 18 is turned, the cable 46 will be moved and will rotate all the actuating pulleys 44, rotating the connected threaded shafts 22 in the same direction. A separate tensioning device 50 may also be attached to the interior of cover 12 to maintain the cable 46 at a proper tension to insure effective operation of the roto cam latches. Effective movement of the cable 46 without slippage can be further assured by positively attaching the cable, preferably by tying off to the pulley 42. Slippage can also be avoided by wrapping the cable at least one full turn around knob pulley 42 and by providing actuating pulleys 44 and knob pulley 42 with a knurled, rough or other high friction surface where the cable 46 contacts the pulley surface. The material from which cable 46 is constructed should also be selected to provide a high coefficient of friction between the cable 46 and the surface of the pulleys.

The need for a separate knob pulley 42 and knob shaft 48 can be eliminated by mounting the single knob 18 on one of the roto cam latches. Thus, the roto cam latch on which the knob 18 is mounted is actuated directly by turning knob 18, and the remaining roto cam latches can be actuated by the movement of cable 46 rotating attached actuating pulleys 44.

It would also be possible to substitute gears for the pulleys in this embodiment, and use an endless chain loop to rotate the gears.

While such a container having a plurality of roto cam latches and a single actuating device is more easily opened than a container having an actuating device for each roto cam latch, it is not preferred because of the increased potential for accidental opening in transit, since the accidental actuation of the single actuating device could open all of the latches simultaneously. However, a balance between reliability and ease of opening can be obtained by providing a container having more than one actuating device, but fewer actuating devices than the total number of roto cam latches. For example, one could construct a container having four roto cam latches and two knobs in the lid, with each knob connected to two latches using the cable and pulley method described above.

One skilled in the art will recognize at once that it would be possible to construct the various components of the present invention from a variety of materials and to modify the placement of the components in a variety of ways. While the preferred embodiment has been described in detail and shown in the accompanying drawings, it will be evident that various further modifications are possible without departing from the scope of the invention as embodied in the claims.

I claim:

1. A latchable container comprising:

a first part having an interior and an exterior;

a second part having an interior and an exterior and adapted to join with said first part to form a container having an interior and an exterior;

a plurality of catch members mounted on the interior of the first part; and, a plurality of locking latches adapted and positioned on the interior of said second part to engage said catch members and pull said catch members towards said locking latches for tightly latching said first part to said second part when said first part and said second part are joined, said locking latches comprising:

a threaded shaft having a first end, a second end and a longitudinal axis passing through said first end and said second end, said first end being supported by the second part of said container;

a means for supporting said threaded shaft at the second end thereof;

a means for rotating said threaded shaft movable from the exterior of said container;

a threaded receiver mounted on said threaded shaft and adapted to travel on said threaded shaft toward said first end of said threaded shaft when said means for rotating is rotated in one direction, and toward said second end of said threaded shaft when said means for rotating is rotated in an opposite direction;

a slidable bracket having a first end, a second end and a generally planar top surface, said first end of said slidable bracket attached to said threaded receiver, and said slidable bracket adapted to slidably move parallel to the longitudinal axis of said threaded shaft;

a movable latch member attached to said second end of said slidable bracket, said movable latch member having a first and a second end, a first end of said movable latch member being formed to engage said catch, and said second end of said movable latch member being attached to said second end of said slidable bracket such that said movable latch member may be rotated up out of or down towards the planar top surface of said slidable bracket and such that said movable latch member may be slidably moved towards and away from the catch;

a means for moving said movable latch member up out of the planar top surface of said slidable bracket; and, a barrier means mounted over said planar top surface of said slidable bracket between said first and second ends of said slidable bracket for acting upon said second end of said movable latch member to force said movable latch member down into the planar top surface of said slidable bracket when said first end of said slidable bracket moves away from said barrier means.

2. The latchable container of claim 1 wherein said first part of said container is a main body of said container and said second part of said container is a cover of said container.

3. The latchable container of claim 1 wherein said means for rotating said threaded shaft of each said locking latch comprises a knob mounted on the exterior of said container and attached to said first end of each said threaded shaft.

4. The latchable container of claim 3 wherein said first end of said threaded shaft of each said locking latch extends from the interior of said container to the exterior.

5. The latchable container of claim 1 wherein said means for rotating said threaded shaft of each said locking latch comprises:

an actuating pulley attached to one end of said threaded shaft of each said locking latch such that movement of said actuating pulley will rotate said threaded shaft;

a cable engaging said actuating pulley of one or more said locking latches such that movement of said cable will cause rotation of said engaged actuating pulley; and, a rotatable actuating means for moving said cable.

6. The latchable container of claim 5 wherein said rotatable actuating means for moving said cable comprises a knob attached to a fixed knob pulley operably engaging said cable.

7. The latchable container of claim 1 wherein said means for moving said movable latch member of each said locking latch up out of the plane of said upper surface of said slidable bracket comprises a small raised wedge positioned between said first end and said second end of said movable latch member.

8. The latchable container of claim 1 wherein said means for moving said movable latch member of each said locking latch up out of the plane of said upper surface of said slidable bracket comprises a spring.

9. The latchable container of claim 1 wherein said means for supporting said threaded shaft and said barrier means of said locking latch are both contained in a single mounting bracket.

10. An apparatus for sealing a container comprising a removable cover, a container body and a seal mounted between the container body and the cover, in which the apparatus can be actuated to draw the cover and container body tightly against the seal to close the container and to make the container substantially watertight and substantially airtight where the container and cover come together, said mechanism adapted to cooperate with a catch, said mechanism comprising:

a threaded shaft having a first end and a second end, and a longitudinal axis passing through the first end and the second end of the threaded shaft;

a means for supporting the first end of the threaded shaft and for rotating said threaded shaft;

a slidable bracke having a first end, a second end and a generally planar top surface, said first end of said slidable bracket including a threaded receiver mounted on said threaded shaft and adapted to travel on said threaded shaft toward said first end of said threaded shaft when said means for rotating is rotated in one direction, and toward said second end of said threaded shaft when said means for rotating is rotated in an opposite direction, thereby adapting the slidable bracket to move parallel to the longitudinal axis of the threaded shaft;

a movable latch attached to the second end of the slidable bracket, the movable latch having a first end and a second end, the first end of the latch being formed to engage the catch, and the second end of the latch being attached to the second end of the slidable bracket such that the latch is movable with the bracket parallel to the longitudinal axis of the threaded shaft towards or away from the catch, and is rotatable up out of or down into the planar top surface of the slidable bracket in order to engage or disengage the catch;

a means for moving the latch up out of the planar top surface of said slidable bracket to permit the latch to disengage the catch; and, a barrier means mounted over the planar top surface of the slidable bracket between the first and second ends of the slidable bracket for forcing the latch down into the planar top surface of the slidable bracket for engaging the catch and sealing the container as the latch is pulled beneath the barrier means as the first end of the slidable bracket moves away from the barrier means.

11. The apparatus of claim 10 in which the apparatus is mounted inside the cover and the catch is mounted inside the container body.

12. The apparatus of claim 10 in which the means for supporting the first end of the threaded shaft and for rotating the threaded shaft is a knob mounted outside the container.

13. The apparatus of claim 10 additionally comprising a means for supporting the threaded shaft at the second end to permit free rotation.

14. The apparatus of claim 13 in which the means for supporting the threaded shaft at the second end is attached to or formed from the barrier means.

15. A locking latch for a container having an interior, an exterior, a first part and a second part, the first part formed by a wall having and interior, an exterior, and a catch mounted on the interior of the wall, and the second part formed by a container wall having an interior and an exterior, the locking latch mounted generally on the interior of the wall of the second part in a position to engage and draw the catch towards the locking latch when the first part and the second part of the container are joined, the locking latch comprises:

a threaded shaft having a first end and a second end, and a longitudinal axis passing through the first end and the second end of the threaded shaft, the first end being supported by the wall of the second part of the container;

a means for supporting the threaded shaft at the second end thereof;

a means for rotating the threaded shaft movable from the exterior of the container, the means for rotating the threaded shaft including and actuating pulley attached to one end of the threaded shaft of said locking latch such that movement of the actuating pulley will rotate the threaded shaft, a cable engaging the actuating pulley of the locking latch such that movement of the cable will cause rotation of said engaged actuating pulley, and a rotatable actuating means for moving the cable.

a threaded receiver mounted on the threaded shaft and adapted to travel on the threaded shaft toward the first end of the threaded shaft when the means for rotating is rotated in one direction, and toward said second end of the threaded shaft when said means for rotating is rotated in an opposite direction;

a slidable bracket having a first end, a second end and a generally planar top surface, the first end of the slidable bracket being attached to the threaded receiver, and the slidable bracket adapted to slidably move parallel to the longitudinal axis of the threaded shaft;

a movable latch member attached to the second end of the slidable bracket, the movable latch member having a first and a second end, and a top surface and bottom surface, said first end of the movable latch member being formed to engage the catch such that the bottom surface of the first end contacts the catch, and the second end of the movable latch member being attached to the second end of the slidable bracket such that the first end of the movable latch member may be moved in the same direction as the slidable bracket and rotated up out of or down towards the planar top surface of the slidable brackets;

a means for moving the movable latch member up out of the planar top surface of the slidable bracket; and, a barrier means mounted over said planar top surface of said slidable bracket between said first and second ends of said slidable bracket for contacting the top surface of the movable latch member to force the movable latch member down into the planar top surface of said slidable bracket when the first end of the slidable bracket moves away from the barrier means.

16. The locking latch of claim 15 wherein the rotatable actuating means for moving the cable comprises a knob attached to a fixed knob pulley operably engaging the cable.

17. The locking latch of claim 15 wherein the means for moving said movable latch member up out of the plane of said upper surface of slidable bracket comprises a small raised wedge positioned between the first end and the second end of the movable latch member.

18. The locking latch of claim 15 wherein the means for moving the movable latch member up out of the plane of the upper surface of the slidable bracket comprises a spring.

* * * * *